US005603810A

United States Patent [19]

Michler

[11] Patent Number: 5,603,810

[45] Date of Patent: Feb. 18, 1997

[54] COKE-OVEN DOOR SEAL

[75] Inventor: August E. Michler, Pittsburgh, Pa.

[73] Assignee: Minnotte Corporations, Pittsburgh, Pa.

[21] Appl. No.: 399,920

[22] Filed: Mar. 7, 1995

[51] Int. Cl.[6] ..... C10B 25/00; F23M 7/00

[52] U.S. Cl. ..... 202/248; 202/242; 202/269; 110/173 R; 49/483.1; 49/490.1

[58] Field of Search ..... 202/248, 269, 202/242; 110/173 R; 49/472, 473, 475.1, 480.1, 483.1, 484.1, 490.1

[56] References Cited

U.S. PATENT DOCUMENTS

| | | | |
|---|---|---|---|
| 2,579,917 | 12/1951 | Fourmanoit | 202/269 |
| 2,744,858 | 5/1956 | Homan | 202/269 |
| 4,016,045 | 4/1977 | Van Ackeren | 202/242 |
| 4,067,778 | 1/1978 | Van Ackeren et al. | 202/248 |
| 4,115,203 | 9/1978 | Naevestad | 202/248 |
| 4,189,352 | 2/1980 | Stanke | 202/248 |
| 4,440,600 | 4/1984 | Cantavespre | 202/248 |
| 4,532,010 | 7/1985 | Durslen et al. | 202/248 |
| 4,676,873 | 6/1987 | Haaf et al. | 202/242 |
| 4,741,808 | 5/1988 | Holz et al. | 202/248 |
| 4,919,764 | 4/1990 | Baird et al. | 202/248 |

*Primary Examiner*—Christopher Kim
*Attorney, Agent, or Firm*—Gary Jarosik; Mark R. Galis

[57] ABSTRACT

A coke-oven door seal and sealing system wherein the coke-oven door seal comprises a sealing arm in angular relation with a door jamb surface, said sealing arm being engagable with said door jamb surface at a knife edge, and said sealing arm protruding beyond said knife edge and away from said door jamb surface creating a reinforcing and ventilating rib for cooling said knife edge which is capable of supporting a secondary sealing means. The sealing system of the present invention comprises a coke-oven door seal, including a sealing arm in angular relation with a door jamb surface, said sealing arm protruding beyond the knife edge at which said sealing arm engages said door jamb surface and a pivotable plunger system which comprises a standard plunger connected to a plunger extension which consists of a pad and a ball joint or other swivel or rocking means.

9 Claims, 4 Drawing Sheets

COKE-OVEN DOOR SEAL

BACKGROUND OF THE INVENTION

A great deal of time and effort has been devoted toward the objective of an upgraded, retrofittable, metal coke-oven door seal. An "upgraded" coke-oven door seal is one which has improved performance over existing seals in emission control and operation. The ultimate objective is to achieve a coke-oven door seal that is practically emission free. Reaching this objective is of great importance as the steel industry is presently faced with tough environmental regulations that limit the amount of by-product from the coking process which can legally be emitted into the atmosphere.

The present invention relates to a coke-oven door seal and more specifically to a self-adjusting, metal coke-oven door seal which can be used to replace any existing coke-oven door seal (e.g., a seal which has become ineffective due to use) without major modifications having to be made to the coke-oven door or the door handling equipment. In other words, the seal of the present invention is retrofittable. The coke-oven door seal of the present invention provides a better seal than currently existing door seals and is extremely effective in controlling emissions from the coking process (i.e., the present invention is an "upgraded" coke-oven door seal). Further, the coke-oven door seal of the present invention can be made to replace virtually any coke-oven door seal now in existence at a relatively low cost. Finally, the present invention relates to a coke-oven door sealing system which includes a coke-over door seal, a unique pivotable plunger system and a secondary seal. The unique pivotable plunge system and the secondary seal both provide for even greater emission control.

Coke-oven doors are placed at the ends of a coke-oven coking chamber. These doors are often times provided with a sealing strip to assure the coking chamber is sealed shut so that by-products of the coking process, such as carbon gases, do not escape the coking chamber and pollute the atmosphere. Such sealing strips are often ineffective because during repeated cycles of the coking process, they harden and warp. As a result, they do not effectively seal the coking chamber.

A seal is necessary in connection with a coke-oven door because the profile congruency of the coke-oven door with the door jamb can be poor due to warpage of the door or the jamb caused by the extreme heat of the coking process. Without the seal, emissions from the coking process would far exceed acceptable levels.

A number of different seals have been used in connection with coke-oven doors. For example, as noted above, many coke-oven doors are provided with a pliable sealing strip which is oriented in perpendicular relation with the door jamb surface. These sealing strips are unacceptable because they have a relatively short lifespan and therefore need to be replaced on a regular basis. Such replacement is expensive. Moreover, coke-oven doors with such sealing strips are often extremely difficult to repair.

Today, most coke-oven doors utilize metal-to-metal contact seals wherein an edge in perpendicular relation to the door jamb surface is mounted to a diaphragm element so that plungers may be used to bias the edge into contact with the door jamb. The contact between the metal edge of the seal and the metal door jamb surface creates a metal-to-metal contact seal. As such, the seal forms a metal-to-metal closure with the coke-oven door jamb.

Generally, a metal-to-metal contact seal is mounted on the body of the coke-oven door and held in place by latching bars which are inserted into hooks which are attached to the door jamb. In operation, pressure is exerted by springs or screws to hold the coke-oven door in place. This pressure actually moves the coke-oven door toward the oven chamber and thereby moves the metal seal into close proximity to the door jamb. At this point, latching pressure is carried to the door seal until the door stops engage the door jamb.

Many times the above steps do not move the seal edge into contact with the door jamb because of distortions in the door or jamb profile. If this happens and additional movement of the seal is required, such movement can be accomplished by plungers mounted on the door behind the coke-oven door seal. These plunger are used to supply pressure on the seal edge to force it into contact with the door jamb. The effective use of currently known plungers oftentimes requires the close attention of coke-oven plant workers to adjust the pressure applied by such plungers.

Existing coke-oven door seals, sealing strips and metal-to-metal contact seals are shown in various prior patents. For example, U.S. Pat. No. 2,579,917 discloses one type of sealing device for coke-oven doors that does not include a metal-to-metal edge contact. Another type of coke-oven door seal is disclosed in U.S. Pat. No. 4,741,808. In that patent, the invention consists of a coke-oven door seal which includes a metal sealing strip and a crowned metal diaphragm. One other type of coke-oven door seal is shown in U.S Pat. No. 4,919,764. That patent discloses an angled leaf spring and seal assembly.

Presently known metal-to-metal contact seals all suffer from one or more of the following problems:

1. The seal is not flexible in terms of conforming to large distortions in jamb profiles;
2. The seal is not sufficiently heat resistant to avoid deforming during repeated cycles of the coking process;
3. The seal needs to be consistently adjusted by coke-plant workers to account for warped doors and/or door jambs and to account for other changes in jamb profiles;
4. The seal is not strong enough to hold in tight contact with the jamb surface during the coking process and thus is not effective in controlling emissions of the coking process; and
5. The seal is not retrofittable to a wide variety of the coke-oven doors now in use and/or is not physically or mechanically suitable for use in steel plants.

The present invention is a novel type of metal-to-metal contact seal and sealing system that overcomes each of the above-referenced limitations of currently known metal-to-metal seals. The manner in which the present invention overcomes these limitations is discussed in detail below.

SUMMARY OF THE INVENTION

The present invention is a sealing system for coke-oven doors which includes a novel coke-oven door seal and a pivotable plunger system. The novel coke-oven door seal of the present invention is a self-adjusting, retrofittable, metal-to-metal coke-oven door seal that: is flexible enough to conform to large warpages or distortions of the jamb profile; is more heat resistant that existing seals; can conform to warpage without the need for periodic adjustment by coke-plant workers; and can be retrofit to virtually every coke-oven door now in use.

An important object of the present invention is to provide an improved coke-oven door seal and sealing system that allows less emissions than presently available seals. Another important object is that the present invention constitute an economical replacement seal which in adaptable to all coke-oven doors presently in use. It is a further objective of the present invention to provide a coke-oven door seal which can self-adjust to distortions in the jamb profile and maintain a tight contact with the jamb surface. Also, it is an object of the present invention to provide a pivotable plunger system to be used in connection with the coke-oven door seal to further restrict unwanted emissions.

The above objectives of the present invention are achieved through the use of a homogeneous one piece reinforced sealing arm which continues beyond the sealing edge and away from the door jamb surface. The sealing arm is to be presented to the door jamb surface at an angle of less than ninety degrees (<90°) to allow for flexibility of the sealing arm as the sealing edge meets with the door jamb surface. Since the jamb has often times become warped due to usage, the flexibility of the sealing arm assures a tight metal-to-metal seal will exist between the sealing edge and the door jamb surface. The pivotable plunger system is then utilized to assure additional pressure is applied directly at the sealing edge. It is necessary that the plunger pivot, usually about a ball joint or other swivel means, so that it can move to apply pressure directly at the sealing edge as the edge moves across the surface of the door jamb. The sealing edge will move relative to the door jamb surface as the door jamb and the sealing edge are brought into contact.

In the present invention, the sealing arm continues beyond the sealing edge toward the outside of the seal and away from the door jamb surface thus creating a rib of the homogenous sealing arm which reinforces and ventilates the sealing edge. This reinforcing and ventilating rib supports the sealing edge of the present invention thereby enabling the sealing edge to form a much tighter seal than can be created by seals presently known in the art. The support and ventilation provided by this rib will allow for a much longer seal life. Such benefits reduce the need for repeated replacement of the seal and also reduce the costs of a replacement seal when one is needed.

It is a further object of the present invention to provide a coke-oven door seal wherein the seal continues beyond the metal to metal contact sealing edge and away from the door jamb thereby creating a rib for mounting a secondary seal of a type known in the art. This secondary seal can be mounted to the outer surface of the reinforcing and ventilating rib and can be a soft seal. This secondary seal provides even greater assurance that by-products of the coking process will not be emitted into the atmosphere. The present invention contemplates the use of either a soft seal or a second metal-to-metal contact seal as a secondary sealing means.

These objects of the present invention, together with other advantages of the invention, will become apparent as the details of the construction and operation of the invention are more fully described below.

DESCRIPTION OF THE PREFERRED EMBODIMENTS

Figure 1:
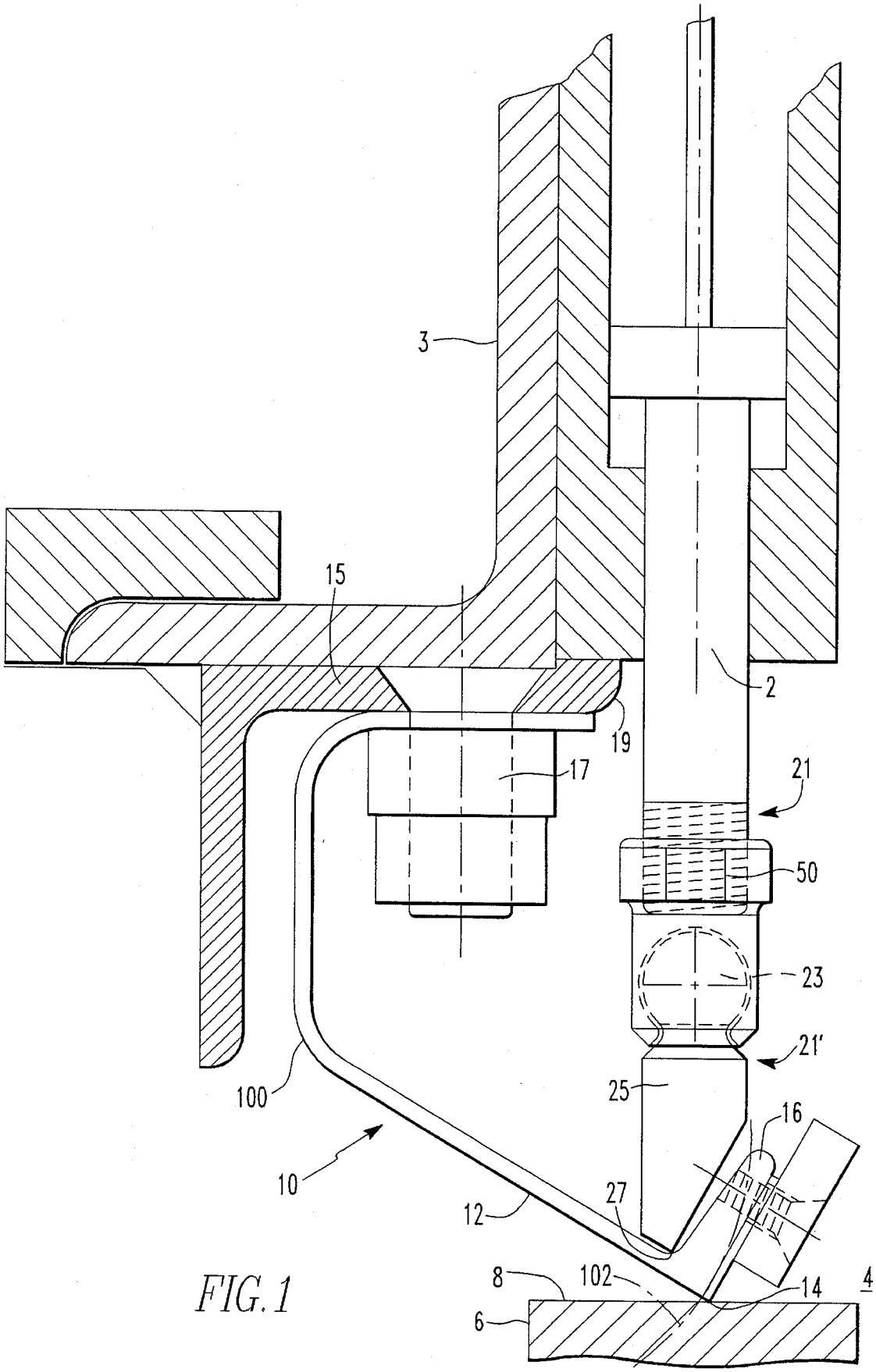
FIG. 1 is a view of a coke-oven door seal according to the present invention.

Referring to FIG. 1, a coke-oven door seal 10 according to the present invention is shown. The coke-oven end closure 4 is only partially illustrated in the drawings. The coke-oven end closure 4 shown in FIG. 1 contains a door body 3, a door jamb 6 and the door jamb surface 8. The door jamb surface 8 is ideally planer and constitutes a metal surface which provides a generally solid surface to be engaged by the coke-oven door seal 10 of the present invention. However, in practice, the intense heat of the coking process causes the door jamb surface 8 to warp or otherwise deform. In addition, tar and other residues often build on the door jamb surface 8. It is the deformation of the door jamb surface 8, among other things, which causes the need for periodic adjustments by coke-plant workers when prior art seals are employed.

The coke-oven door seal 10 of the present invention includes a sealing arm 12 secured to a diaphragm element 15. The sealing arm 12, which can be a rolled steel structural section, a formed steel plate section, or a similarly formed piece of material which demonstrates steel-like properties, extends from the diaphasm element 15 toward and then away from the door jamb surface 8. The door jamb surface 8 is engaged with the sealing arm 12 along a metal-to-metal knife edge 14. In contrast to presently known seals, the sealing arm 12 of the present invention does not terminate at the knife edge 14. The sealing arm 12 protrudes beyond the knife edge 14 toward the outside of the coke-oven door seal 10 and away from the door jamb surface 8. The portion of the homogenous sealing arm 12 protruding beyond the knife edge 14 and away from the door jamb surface 8 constitutes a reinforcing and ventilating rib 16.

The sealing arm 12 is attached to the diaphragm element 15 by means of a bolt 17 and gaskets 19 or by other similar fastening means. The diaphragm element 15 is supported from the body of the coke-oven door 3 by the use of any number of fastening devices currently known in the art. A unique pivotable plunger system 21 can be utilized to provide pressure on the seal 10 and move the seal 10 forward after the coke-oven end closure 4 is locked in place. The movement of the pivotable plunger system 21 needed to apply the necessary sealing pressure to the knife edge 14 will be determined by conditions existing at the time of sealing. As will become apparent, it is important that the pressure applied by the pivotable plunger system 21 follow the movement of the knife edge 14 of the seal 10 so as to assure a tight contact between the seal 10 and the door jamb surface 8. The pivotable plunger system 21 consists of a standard plunger 2 (of a type known in the art), which is supported from the door body 3, and a plunger extension 21'. The plunger extension 21' can be connected to the standard plunger 2 by means of a screw 50 or any other connecting means known in the art. The plunger extension 21' includes a ball joint 23, or other swivel or rocking means, and a pad 25.

During operation, the standard plunger 2 is moved toward the door jamb surface 8 which movement cause the plunger-extension 21' to also move toward the door jamb surface 8 which in turn causes the pad 25 to be brought into contact with the back of the knife edge 27 thereby putting pressure on the sealing arm 12 at the point opposite the knife edge 14.

This in turn forces the knife edge 14 into greater sealing contact with the door jamb surface 8. The pivotable movement of the pad 25 is necessary to assure that the pressure applied through the plunger system 21 will always be directed at the point on the sealing arm 12 directly opposite the knife edge 14 (i.e., at the back of the knife edge 27). This assures pressure is not applied by the plunger system 21 elsewhere on the sealing arm 12 thereby bending said sealing arm 12 and forcing said knife edge 14 to be moved away from the door jamb surface 8. The diaphragm element 15 is provided with a plurality of refractories (not seen) associated with the door body 3.

Figure 2:
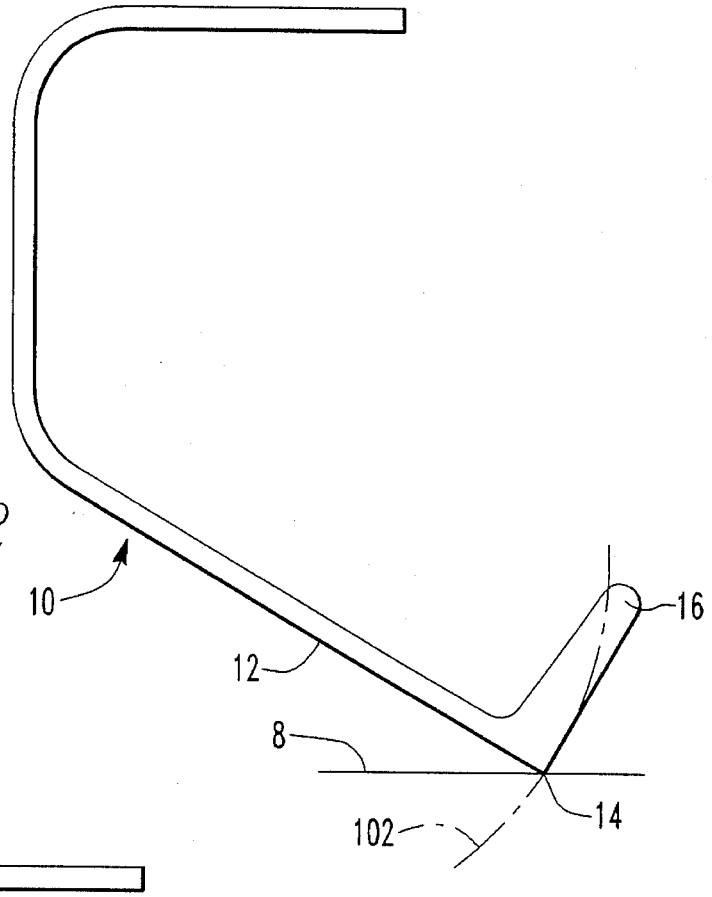
FIGS. 2 and 2*a* show a simplified view of a coke-oven door seal according to the preferred embodiments of the present invention.
Figure 2A:
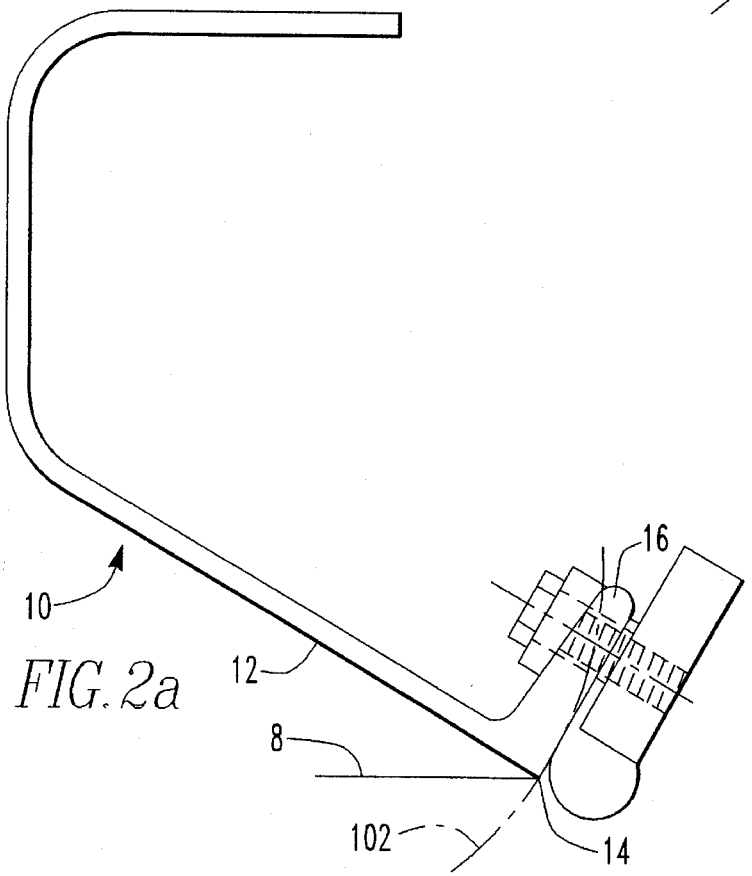

Referring now to FIGS. 2 and 2*a*, the knife edge 14 of the present invention is presented to the door jamb surface 8 at an angle of less than 90°. By presenting the knife edge 14 at this acute angle, the knife edge 14 is able to mate with the jamb surface 8 regardless of how the jamb surface 8 has been deforming or warped during prior coking processes. The portion of the sealing arm 12 which protrudes past the knife edge 14 toward the outside of the seal 10 and away from the door jamb surface 8 creates a sealing edge reinforcing and ventilating rib 16. This reinforcing and ventilating rib 16 cools and supports the knife edge 14 to assure that it remains in contact with the jamb surface 8. The cooling of the knife edge 14 is caused by the fact that the reinforcing and ventilating rib 16 exists in an atmosphere at a much lower temperature that exists at the door jamb surface 8.

Referring back to FIG. 1, the sealing arm 12 is sufficiently flexible so that the knife edge 14 may move in relation to the jamb surface 8 to assure that the most ideal seal is obtained. The plunger system 21 described above can be used to move the seal 10 forward into even greater sealing contact with the door jamb surface 8. As noted, the force on the sealing arm 12 created by the plunger system 21 must be directly at the knife edge 14 and must follow the movement of the knife edge 14. The flexibility of the sealing arm 12 allows the knife edge 14 to be placed in tight contact with the jamb surface 8. The flexing occurs at the point 100 on the sealing arm 12. As the sealing arm 12 flexes, the knife edge 14 moves smoothly along the surface of the door jamb 8 while maintaining a tight metal-to-metal contact with the jamb surface 8. Additional sealing pressure is applied by the plunger system 21 at a point 27 directly opposite the knife edge 14. While the sealing arm 12 is flexing, the movement of the knife edge 14 relative to the ground is in an arc 102 which is shown in FIGS. 1, 2 and 2*a*.

Figure 3A:
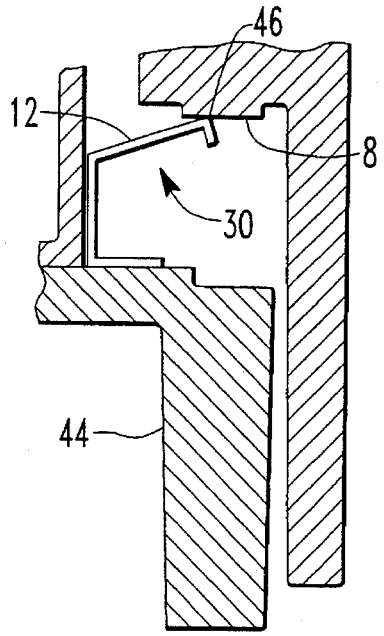
FIG. 3 is a sectional view of various other embodiments of a coke-oven door seal built according to the present invention.
Figure 3B:
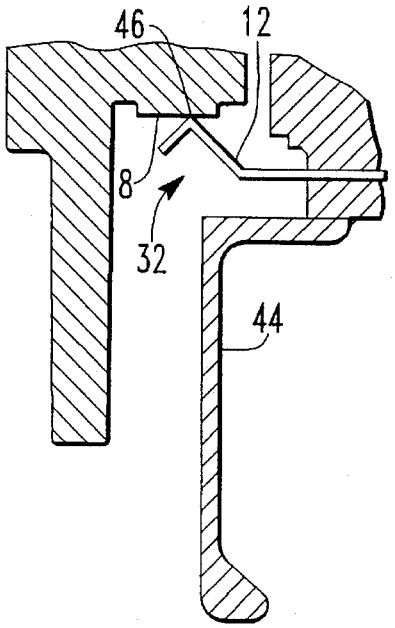
Figure 3C:
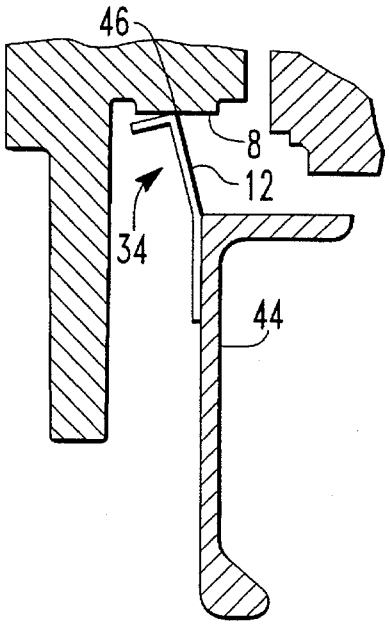

Referring to FIG. 3, various other embodiments of a coke-oven door seal 10 built according to the teachings of the present invention are shown. Each of these different shaped seals 30, 32 and 34 employs the principals discussed above in connection with the embodiment of the invention described above. The only difference in the embodiments shown in FIG. 3 is in the shape of the sealing arm 12 between the point at which it is fastened to the diaphragm element 44 and the point 46 at which it contacts the door jam surface 8. Each of these different embodiments can be used to replace a currently known coke-oven door seal.

Figure 4:
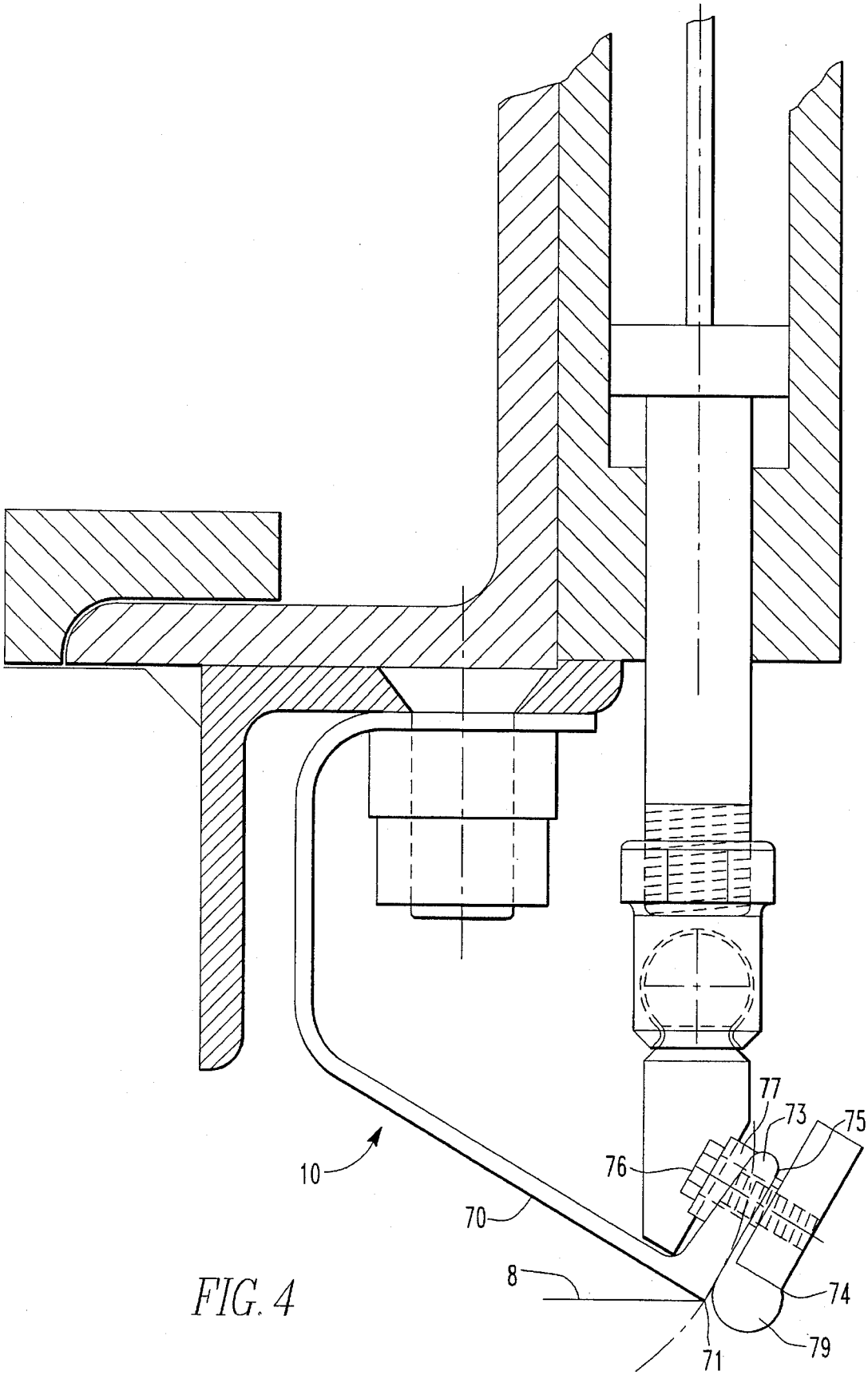
FIG. 4 is a sectional view of a coke-oven door including secondary sealing means according to the present invention.

Referring to FIG. 4, a coke-oven door seal 10 is shown wherein the sealing arm 70 continues beyond the metal-to-metal contact knife edge 71 and away from the door jamb surface 8. The rib 73 of the sealing arm 70 extending away from the door jamb surface 8 toward the outside of the seal 10 is utilized for mounting a secondary seal 74. The secondary seal 74 is mounted to the outside 75 of the rib 73 by means of a bolt 76 and washer 77 or by any other fastening means known in the art. This secondary seal may be a soft seal 79 as shown in FIG. 4 or may be a second metal-to-metal contact seal. This secondary seal 74 will assure that by-products of the coking process do not escape into the atmosphere.

The foregoing illustrates the principles of the present invention. However, numerous modifications and changes to the invention will occur to those skilled in the art. This disclosure is not desired to limit the invention in any fashion.

I claim:

1. A coke-oven door seal comprising a sealing arm in angular relation with a door jamb surface; said sealing arm engageable with said door jamb surface at a knife edge; said sealing arm protruding beyond said knife edge and away from said door jamb surface; said knife edge movable along said door jamb surface.

2. A coke-oven door seal comprising a flexible sealing arm in angular relation with a door jamb surface; said sealing arm engageable with said door jamb surface at a knife edge; said sealing arm protruding beyond said knife edge and away from said door jamb surface creating a reinforcing and ventilating rib; said sealing arm having a flex point; said knife edge movable in relation to said flex point and along said door jamb surface.

3. The invention of claim 2 wherein a secondary sealing means is attachable to said reinforcing and ventilating rib.

4. The invention of claim 3 wherein said secondary sealing means includes a soft seal.

5. The invention of claim 2 wherein a pivotable plunger system is utilized to force said knife edge into sealing contact with said door jamb surface.

6. The invention of claim 5 wherein said pivotable plunger system consists of a plunger, a plunger extension and a connector means for securing said plunger to said plunger extension.

7. The invention of claim 6 wherein said plunger extension consists of a pad which is pivotable about a ball joint.

8. A coke-oven door seal for engagement with the surface of a coke-oven door jamb, said seal including an angled sealing arm for engagement with said jamb surface at a knife edge, said sealing arm including a reinforcing and ventilating rib for cooling said knife edge of said sealing arm, said reinforcing and ventilating rib supporting a secondary sealing means.

9. A coke-oven door sealing system comprising: a coke-oven door seal including a flexible sealing arm in angular relation with a door jamb surface, said sealing arm protruding beyond a knife edge at which said sealing arm may engage said door jamb surface; and a pivotable plunger system including a plunger connected to a plunger extension consisting of a pad and ball joint.

* * * * *